US010644373B2

(12) United States Patent
Deleniv et al.

(10) Patent No.: US 10,644,373 B2
(45) Date of Patent: May 5, 2020

(54) RIDGE WAVEGUIDE TO A PARTIAL H-PLANE WAVEGUIDE TRANSITION

(71) Applicant: Telefonaktiebolaget LM Ericsson (publ), Stockholm (SE)

(72) Inventors: Anatoli Deleniv, Mölndal (SE); Piotr Kozakowski, Mölndal (SE); Ove Persson, Hunnebostrand (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 85 days.

(21) Appl. No.: 15/764,506

(22) PCT Filed: Nov. 3, 2015

(86) PCT No.: PCT/EP2015/075630
§ 371 (c)(1),
(2) Date: Mar. 29, 2018

(87) PCT Pub. No.: WO2017/076437
PCT Pub. Date: May 11, 2017

(65) Prior Publication Data

US 2018/0277919 A1 Sep. 27, 2018

(51) Int. Cl.
*H01P 5/08* (2006.01)
*H01P 3/123* (2006.01)
(Continued)

(52) U.S. Cl.
CPC ..... *H01P 5/082* (2013.01); *H01P 1/2016* (2013.01); *H01P 3/123* (2013.01); *H01P 11/002* (2013.01); *H01P 1/201* (2013.01)

(58) Field of Classification Search
CPC ..... H01P 5/082; H01P 11/002; H01P 3/123; H01P 1/2016; H01P 1/201
(Continued)

(56) References Cited

U.S. PATENT DOCUMENTS 4,673,946 A * 6/1987 Hoover ..... H01P 5/082 333/21 A
2002/0097109 A1* 7/2002 du Toit ..... H01P 5/107 333/26
(Continued)

OTHER PUBLICATIONS

International Search Report and Written Opinion of the International Searching Authority for International Application No. PCT/EP2015/075630 dated Jul. 12, 2016, 9 pages.
(Continued)

*Primary Examiner* — Robert J Pascal
*Assistant Examiner* — Jorge L Salazar, Jr.
(74) *Attorney, Agent, or Firm* — Sage Patent Group

(57) ABSTRACT

A waveguide transition includes a ridge waveguide section with a first ridge part running along a first wall having a first distance to an opposing second wall. The waveguide transition comprises a partial H-plane waveguide section with an electrically conducting foil that comprises a longitudinally running foil slot ending a certain edge distance before a foil edge that faces the ridge waveguide section. The ridge waveguide section and the partial H-plane waveguide section overlap during a transition section that has a first end at a transition between the second wall and a third wall. There is a second distance between the first wall and the third wall that exceeds the first distance. The transition section has a second end where the first ridge part ends by a transversely running second ridge part that crosses the foil slot and connects to a third wall.

6 Claims, 6 Drawing Sheets

Section A-A

(51) Int. Cl.
*H01P 1/201* (2006.01)
*H01P 11/00* (2006.01)

(58) Field of Classification Search
USPC .... 333/22 R, 157, 208, 239, 248, 251, 21 A, 333/34, 26, 254
See application file for complete search history.

(56) References Cited

U.S. PATENT DOCUMENTS

2008/0186113 A1* 8/2008 Hoover ..... H01P 1/02 333/249
2013/0271235 A1 10/2013 Kai

OTHER PUBLICATIONS

Kloke et al., "Coaxial End-Launched and Microstrip to Partial H-Plane Waveguide Transitions," IEEE Transactions on Microwave Theory and Techniques, vol. 63, No. 10, Oct. 2015, 6 pages.

* cited by examiner

Section A-A

Section B-B

RIDGE WAVEGUIDE TO A PARTIAL H-PLANE WAVEGUIDE TRANSITION

CROSS REFERENCE TO RELATED APPLICATION

This application is a 35 U.S.C. § 371 national stage application of PCT International Application No. PCT/EP2015/075630, filed on Nov. 3, 2015, the disclosure and content of which is incorporated by reference herein in its entirety.

TECHNICAL FIELD

The present disclosure relates to a ridge waveguide to a partial H-plane waveguide transition.

BACKGROUND

Waveguide components are an essential part of modern communication systems. Despite impressive progress in the last few decades in the microwave technology, the important role of waveguide components remains undisputed.

RF (Radio Frequency) filters such as microwave filters are indispensable passive components, in any RF/microwave communication system. Waveguide filters are of particular importance due to their low insertion loss characteristics and high power handling capabilities. However, waveguide filters have the disadvantages of being of large size and having a relatively high weight at lower frequency ranges. Therefore, substantial effort has been made to reduce the size and mass of waveguide filters without degrading their electrical performance; in particular, in terms of insertion loss, out-of-band rejection and/or group delay variation.

To this end, a number of configurations have been developed and reported. These include multimode filters, where at least two modes operating within the same resonant cavity are coupled. This allows one to realize higher order filter without increasing its overall size.

Another class of reduced size waveguide filters utilizes ridge waveguide resonators, where a reduction in size stems from the fact that the cut-off frequency of the dominant mode of the ridge waveguide is lower than that of the rectangular waveguide of the same cross section.

Another class of waveguide filters is the all metal insert partial H-plane waveguide filters. These components offer reduced size and are similar to the all metal insert E-plane filters as they comprise a metal insert running along two halves of a split waveguide enclosure.

Since partial H-plane filter frequency characteristic is determined mainly by a metal insert, only a metal insert needs to be replaced whenever filter requirements are redefined. This means that a set of metal inserts and a common waveguide enclosure is sufficient to cover the frequency plan defined for a system operating in a given frequency band.

Therefore, all metal insert partial H-plane filters can be regarded as an alternative to the standard H-plane waveguide filters when the reduced size is paramount. However, metal insert partial H-plane filters are typically coupled by means of coaxial conductors. As far as system integration is concerned, this can be viewed as a limiting factor of the filter application as many systems require a waveguide connection.

There is thus a need for a reliable low-loss transition component between a single ridge waveguide and a partial H-plane waveguide.

SUMMARY

The object of the present disclosure is to provide a reliable low-loss transition component between a single ridge waveguide and a partial H-plane waveguide.

Said object is achieved by means of a waveguide transition comprising a ridge waveguide section that in turn comprises a first ridge part, running along a first wall in the ridge waveguide section, where there is a first distance between the first wall and an opposing second wall. The waveguide transition comprises a partial H-plane waveguide section that in turn comprises at least one electrically conducting foil arranged inside the partial H-plane waveguide section. The foil comprises a longitudinally running foil slot ending a certain edge distance before a foil edge that faces the ridge waveguide section. The ridge waveguide section and the partial H-plane waveguide section overlap during a transition section that has a first end at a transition between the second wall and a third wall. The third wall is parallel to the second wall, and there is a second distance between the first wall and the third wall that exceeds the first distance. The transition section has a second end where the first ridge part ends by means of a transversely running second ridge part that crosses the foil slot and connects to a third wall, perpendicular to the first wall.

According to an example, the waveguide transition comprises a first main part which in turn comprises a first waveguide section part and a second main part which in turn comprises a second waveguide section part. The main parts are arranged to be mounted to each other such that the first waveguide section part and the second waveguide section part form the ridge waveguide section and the partial H-plane waveguide section with the foil positioned between the main parts.

According to another example, there is a ridge distance between an edge of the second ridge part that faces a foil slot end, and the foil slot end.

According to another example, at least one of the first ridge part and the second ridge part has at least one either stepped or continuous change of at least one of width and height.

Other examples are evident from the dependent claims.

A number of advantages are obtained by means of the present disclosure, mainly a reliable low-loss transition component between a single ridge waveguide and a partial H-plane waveguide is provided.

BRIEF DESCRIPTION OF THE DRAWINGS

The present disclosure will now be described more in detail with reference to the appended drawings, where.

DETAILED DESCRIPTION

Figure 1:
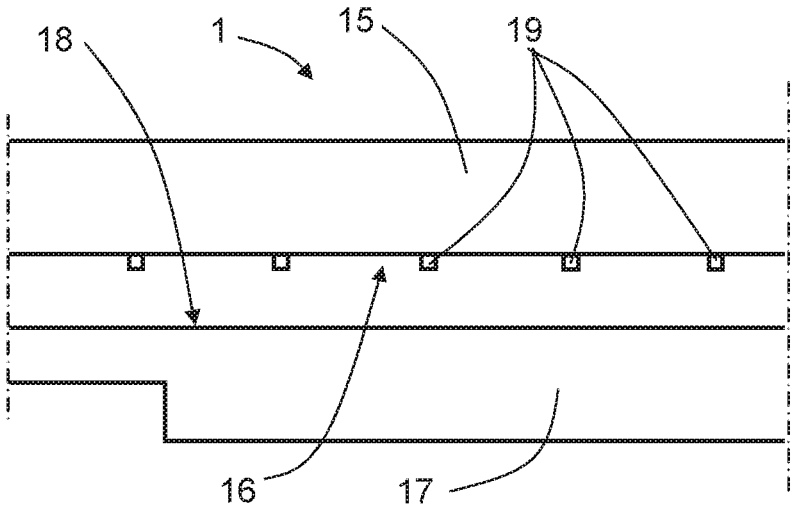
FIG. 1 shows a side view of a waveguide transition comprising a first main part and a second main part, not assembled.
Figure 2:
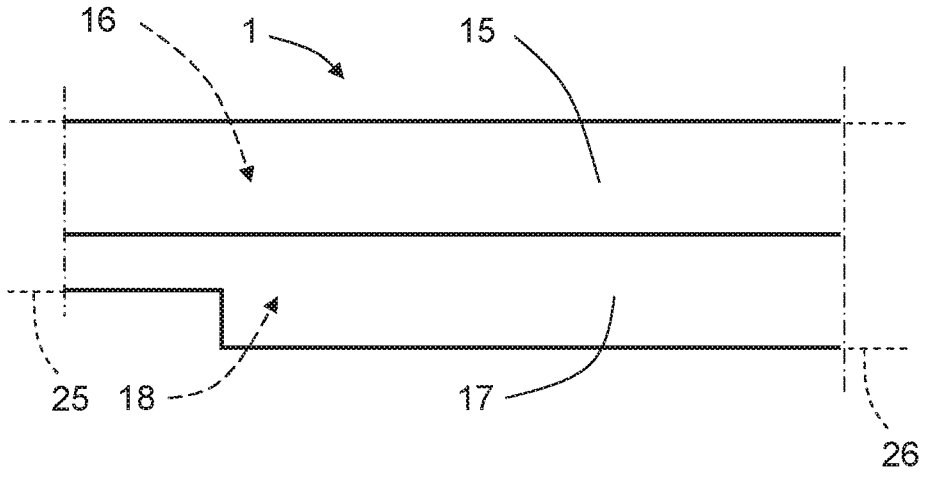
FIG. 2 shows a side view of the waveguide transition comprising a first main part and a second main part, assembled.

With reference to FIG. 1 and FIG. 2 there is waveguide transition 1 that comprises a first main part 15 and a second main part 17. In FIG. 1, the main parts 15, 17 are not fully assembled, and in FIG. 2 they are fully assembled.

Figure 3:
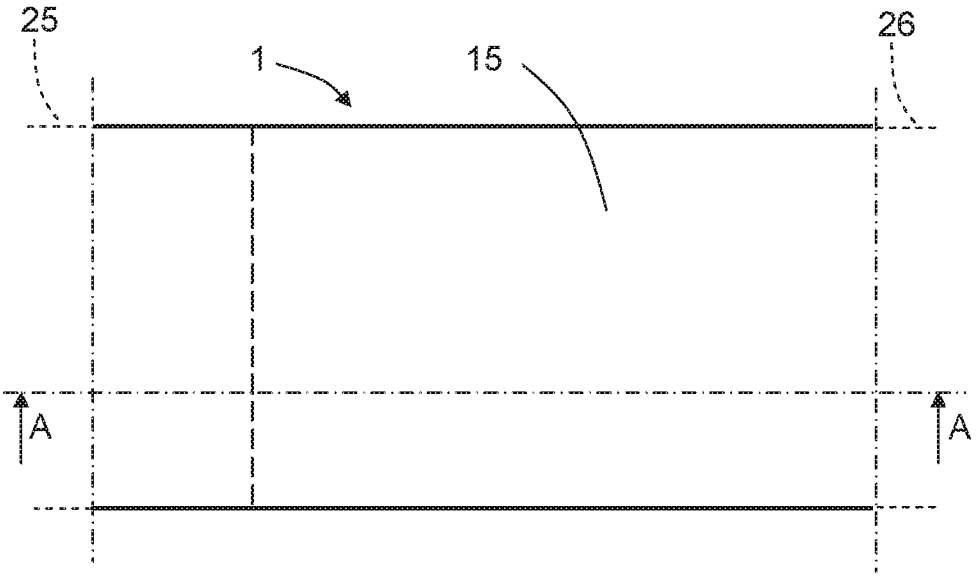
FIG. 3 shows a top view of the waveguide transition.
Figure 4:
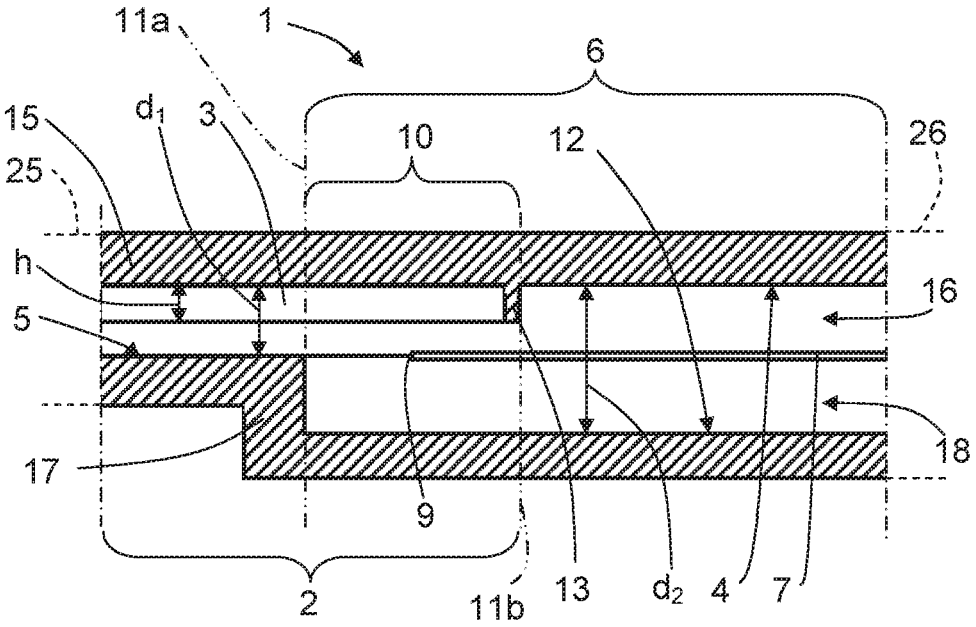
FIG. 4 shows a cross-sectional view taken along the line A-A of FIG. 3.

With reference also to FIG. 3 that shows a top view of the waveguide transition 1 and FIG. 4 that shows a cross-section of the waveguide transition 1 in FIG. 3 according to a first example, the first main part 15 comprises a first waveguide section part 16 and the second main part 17 comprises a second waveguide section part 18. The waveguide transition 1 comprises a ridge waveguide section 2 that in turn comprises a first ridge part 3 running along a first wall 4 in the ridge waveguide section 2. There is a first distance $d_1$ between the first wall 4 and an opposing second wall 5.

According to the present disclosure, the waveguide transition 1 comprises a partial H-plane waveguide section 6 that in turn comprises at least one electrically conducting foil 7 arranged inside the waveguide section 6. The electrically conducting foil 7 is thus sandwiched between the main parts 15, 17 and runs in an H-plane.

The main parts 15, 17 are thus arranged to be mounted to each other such that the first waveguide section part 16 and the second waveguide section part 18 form the ridge waveguide section 2 and the partial H-plane waveguide section 6 with the electrically conducting foil 7 positioned between the main parts 15, 17.

Figure 5:
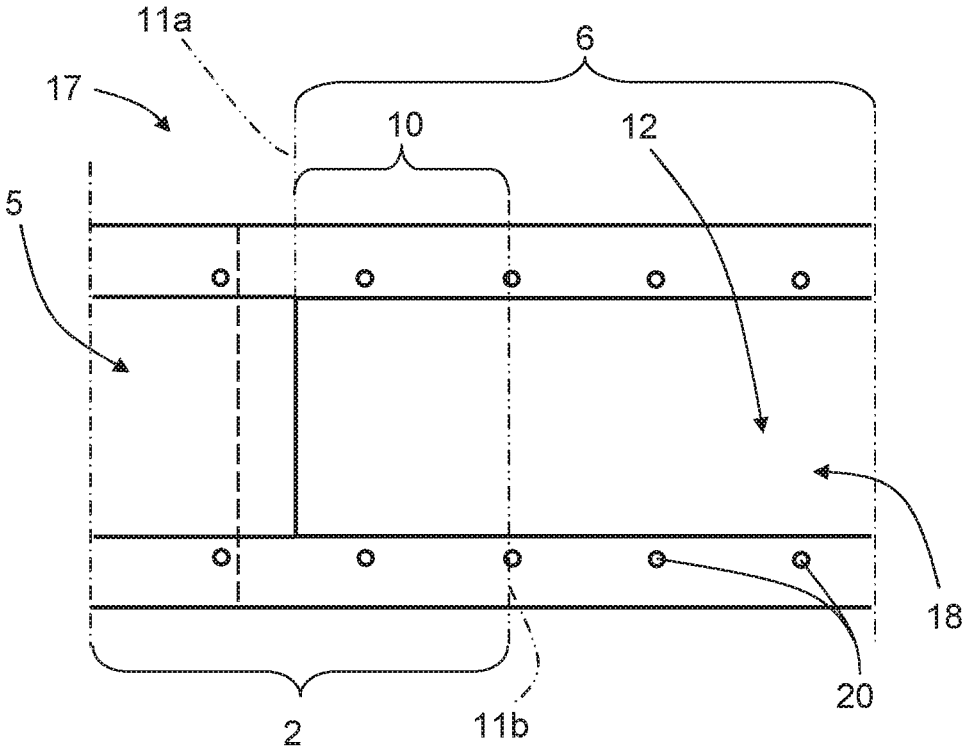
FIG. 5 shows a top view of the second main part.
Figure 6:
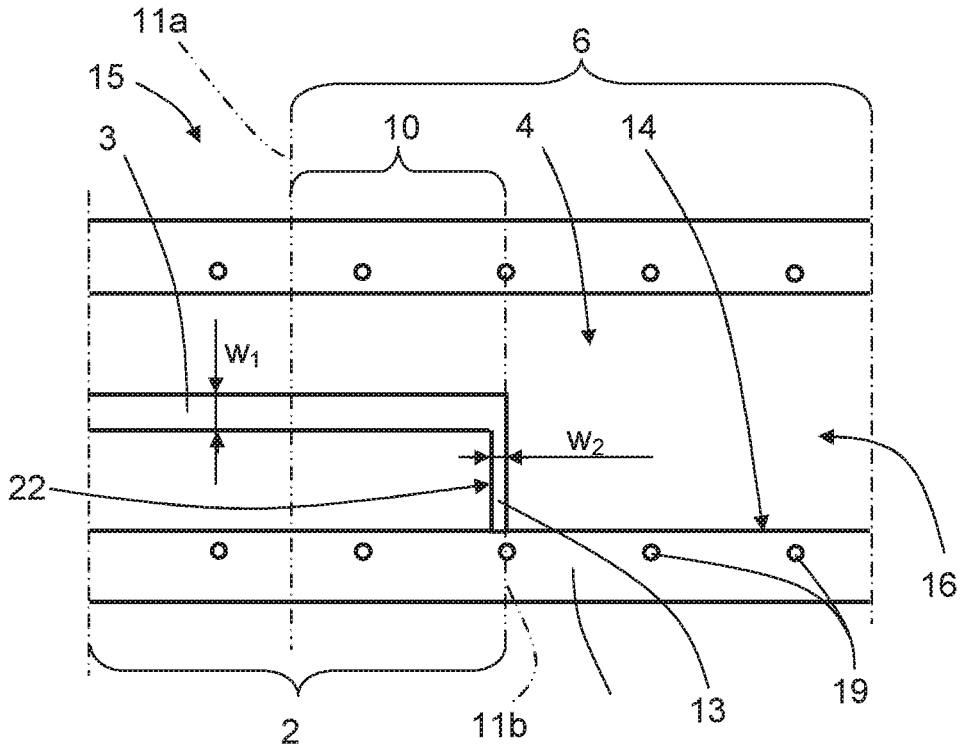
FIG. 6 shows a bottom view of the first main part according to a first example.

All the above parts will now be described more in detail with reference also to FIG. 5 that shows a top view of the second main part 17, FIG. 6 that shows a bottom view of the first main part 15 according to the first example, FIG. 7 that shows a top view of the electrically conducting foil 7 and FIG. 8 that shows a bottom view of the first main part 15 according to the first example with the electrically conducting foil 7 mounted.

The electrically conducting foil 7 comprises a longitudinally running foil slot 8 ending a certain edge distance $d_e$ before a foil edge 9 that is arranged to face the ridge waveguide section 2 when the electrically conducting foil 7 is mounted. The ridge waveguide section 2 and the partial H-plane waveguide section 6 overlap during a transition section 10 that has a first end 11*a* at a transition between the second wall 5 and a third wall 12. The third wall 12 is parallel to the second wall 5, and there is a second distance $d_2$ between the first wall 4 and the third wall 12 that exceeds the first distance $d_1$.

The transition section 10 furthermore has a second end 11*b* where the first ridge part 3 ends by means of a transversely running second ridge part 13 that crosses the foil slot 8 when the electrically conducting foil 7 is mounted, and connects to a third wall 14, perpendicular to the first wall 4.

It is to be noted that the ridge waveguide section 2 that is comprised in the waveguide transition 1 normally is comprised in a continuing ridge waveguide 25, schematically indicated in FIG. 2, FIG. 3 and FIG. 4, which is implied by a dash-dotted line that indicates an end to the ridge waveguide section 2. In the same way, the partial H-plane waveguide section 6 and its electrically conducting foil 7 are normally comprised in a continuing partial H-plane waveguide part 26 schematically indicated in FIG. 2, FIG. 3 and FIG. 4, which is implied by dash-dotted lines that indicates an end to the partial H-plane waveguide section 6. The electrically conducting foil 7 normally continues to run along at least a part of such a continuing partial H-plane waveguide. The extensions of the ridge waveguide section 2 and the partial H-plane waveguide section 6 are not of importance but they should at least comprise the overlapping parts that constitute the transition section 10, since the inventive concept lies in this transition section 10.

The first main part 15 comprises a first wall 4, a first ridge part 3, a second ridge part 13 and a plurality of guiding pins 19 (only a few indicated in the relevant figures for reasons of clarity), while the second main part 17 comprises a plurality of corresponding guiding apertures 20 (only a few indicated in the relevant figures for reasons of clarity), arranged to receive said guiding pins 19 when the main parts 15, 17 are mounted to each other.

Figure 7:
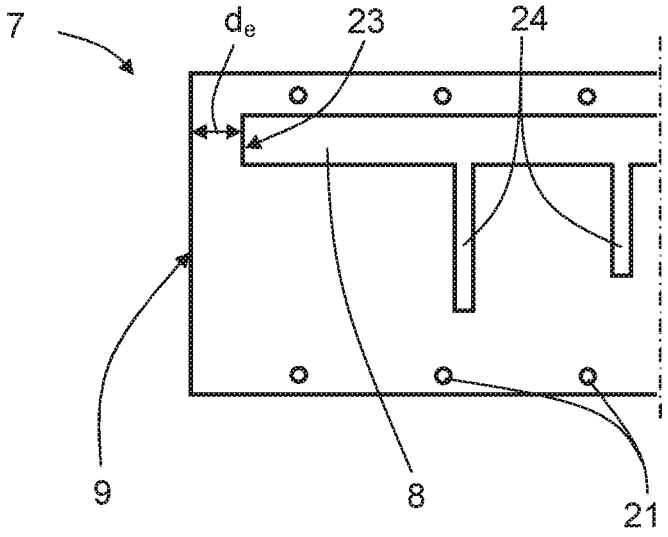
FIG. 7 shows a top view of an electrically conducting foil.
Figure 8:
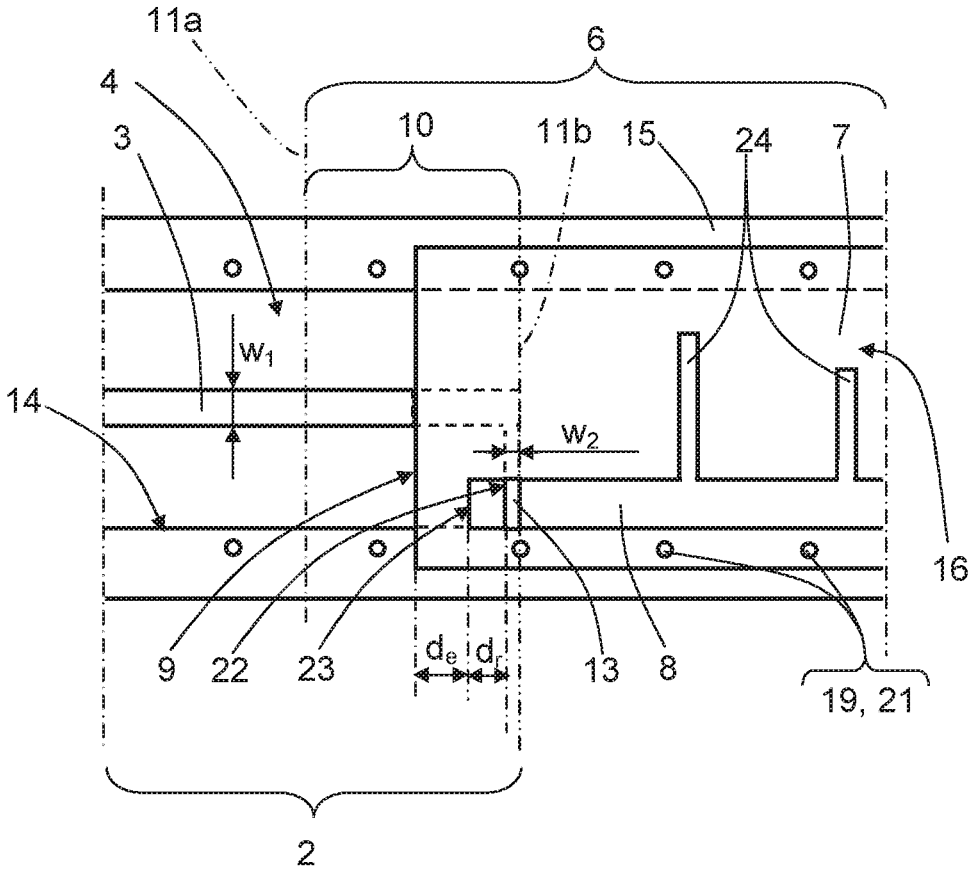
FIG. 8 shows a bottom view of the first main part according to the first example with the electrically conducting foil mounted.

As shown in FIG. 7, the electrically conducting foil 7 comprises corresponding foil apertures 21, and as shown in FIG. 8, at least some of the guiding pins 19 are arranged to protrude corresponding foil apertures 21. Furthermore, the electrically conducting foil 7 may comprise tuning slots or similar structures (not shown) in a previously well-known manner.

There is a ridge distance $d_r$ between an edge 22 of the second ridge part 13 that faces a foil slot end 23, and the foil slot end 23. This ridge distance $d_r$ should not fall below zero.

In this first example, the first ridge part 3 and the second ridge part 13 both have a certain ridge height h that falls below the first distance $d_1$, while the first ridge part 3 has a first width $w_1$ and the and the second ridge part 13 has a second width $w_2$ that falls below the first width $w_1$.

Figure 9:
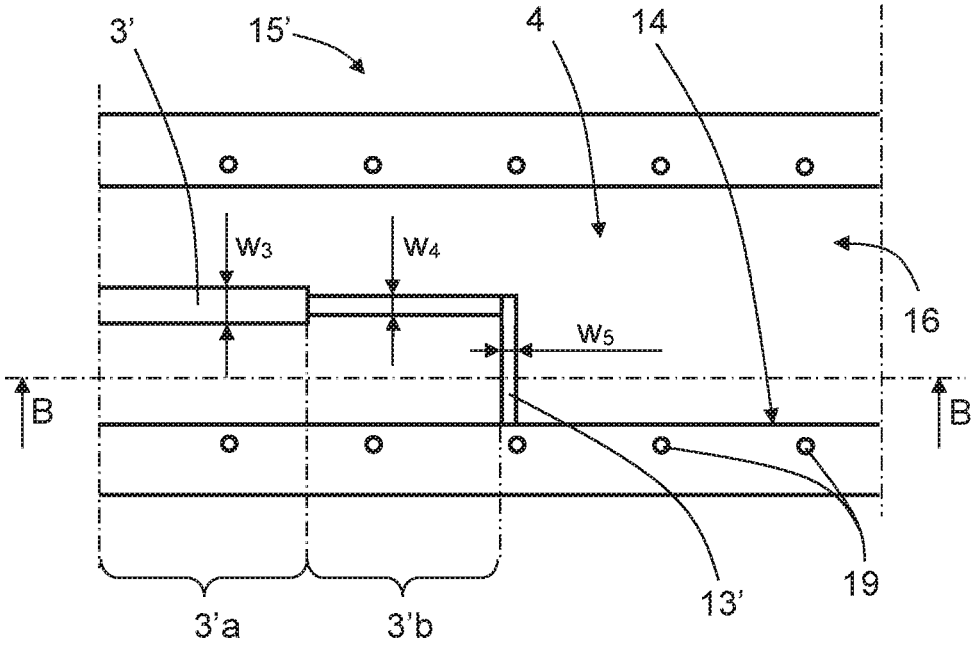
FIG. 9 shows a bottom view of the first main part according to a second example.
Figure 10:
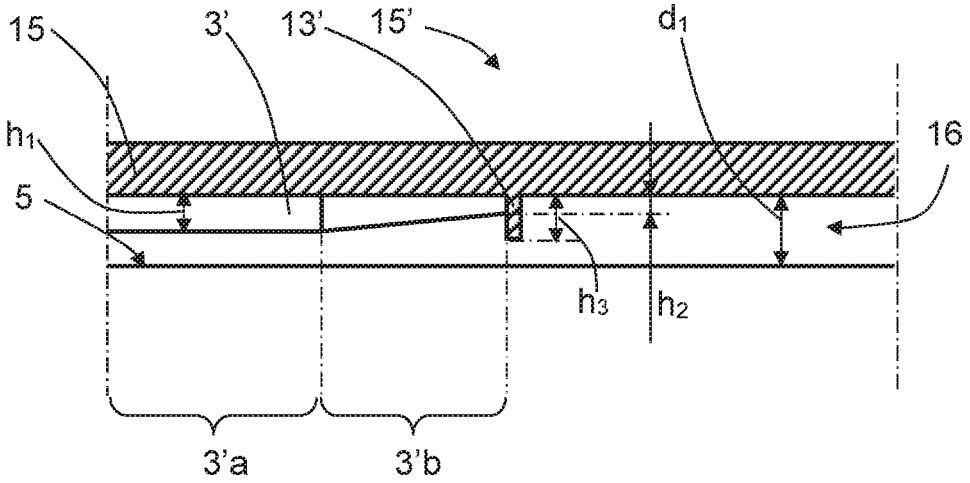
FIG. 10 shows a cross-section of FIG. 9.

According to a second example with reference to FIG. 9 that shows a bottom view of a first main part 15' and FIG. 10 shows a cross-section of FIG. 9, the first ridge part 3' has a first section 3'*a* and a second section 3'*b*, where the first section has a third width $w_3$ and the second section 3'*b* has a fourth width $w_4$ that falls below the third width $w_3$. The second ridge part 13' has a fifth width $w_5$ that exceeds the fourth width $w_4$ and falls below the third width $w_3$.

Furthermore, the first section 3'*a* has a first height $h_1$ along its extension, and the second section 3'*b* has a height that decreases continuously from the first height $h_1$ to a second height $h_2$ that consequently falls below the first height $h_1$. The second ridge part 13' has a third height $h_3$ along its extension, where the third height $h_3$ that exceeds the first height $h_1$ and the second height $h_2$. such that the change from the second height $h_2$ to the third height $h_3$ takes place in a step.

The above only illustrated example of how the first ridge part 3 and the second ridge part 13 may be formed; a vast plurality of alternative forms are of course conceivable; the first ridge part 3 and the second ridge part 13 should be formed such that desired electrical properties are obtained. Generally, at least one of the first ridge part 3, 3' and the second ridge part 13, 13' has at least one either stepped or continuous change of at least one of width $w_1$, $w_2$; $w_3$, $w_4$, $w_5$ or height h; $h_1$, $h_2$, $h_3$.

By means of the waveguide transition 1 described, having a meander ridge extending into a partial H-plane waveguide 26 and comprising a first ridge part 3 and a second ridge part 13 that is short-circuited at the end, no separate intervening transmission coaxial conductor connection between the ridge waveguide 25 and the partial H-plane waveguide 26 is needed.

The field distribution of the dominant mode of a ridge waveguide approximates that of a parallel plate mode. The electric field is concentrated in a gap between the ridge parts 3, 13; 3', 13' and the wall 5 opposing the ridge parts 3, 13; 3', 13', here the gap defined by the difference between the first distance $d_1$ and the height h; $h_1$, $h_2$, $h_3$. of the ridge parts 3, 13; 3', 13'. The electric field of the electromagnetic wave guided along the ridge parts 3, 13; 3', 13' couples to the partial H-plane waveguide 26 by means of the slot 8 in the electrically conducting foil 7. The ridge parts 3, 13; 3', 13' and the slot 8 are physically designed to transform the impedance of the ridge waveguide 25 to match that of the partial H-plane waveguide 26. The broadband low reflection response of the waveguide transition 1 depends on the dimensions of the said elements.

The present disclosure is not limited to the examples above, but may vary freely within the scope of the appended claims. For example, the electrically conducting foil 7 may have any number and shape of suitable slots and apertures In order to obtain desired filter characteristics.

The electrically conducting foil 7 may be made in any suitable material such as copper, gold or aluminium.

The main parts 15, 17 may be made in any suitable material such as aluminium or plastics covered with an electrically conducting layer.

When terms such as parallel, transversely and perpendicular are used, these terms are not to be interpreted as mathematically exact, but within what is practically obtainable and/or desirable.

Generally, the present disclosure relates to a waveguide transition 1 comprising a ridge waveguide section 2 that in turn comprises a first ridge part 3 running along a first wall 4 in the ridge waveguide section 2, where there is a first distance $d_1$ between the first wall 4 and an opposing second wall 5. The waveguide transition 1 comprises a partial H-plane waveguide section 6 that in turn comprises at least one electrically conducting foil 7 arranged inside the partial H-plane waveguide section 6 and comprising a longitudinally running foil slot 8 ending a certain edge distance $d_e$ before a foil edge 9 that faces the ridge waveguide section 2, where the ridge waveguide section 2 and the partial H-plane waveguide section 6 overlap during a transition section 10 that has a first end 11*a* at a transition between the second wall 5 and a third wall 12, the third wall 12 being parallel to the second wall 5, where there is a second distance $d_2$ between the first wall 4 and the third wall 12 that exceeds the first distance $d_1$, and where the transition section 10 has a second end 11*b* where the first ridge part 3 ends by means of a transversely running second ridge part 13 that crosses the foil slot 8 and connects to a third wall 14, perpendicular to the first wall 4.

According to an example, the waveguide transition 1 comprises a first main part 15 which in turn comprises a first waveguide section part 16 and a second main part 17 which in turn comprises a second waveguide section part 18, the main parts 15, 17 being arranged to be mounted to each other such that the first waveguide section part 16 and the second waveguide section part 18 form the ridge waveguide section 2 and the partial H-plane waveguide section 6 with the foil 7 positioned between the main parts 15, 17.

According to an example, the first main part 15 comprises the first wall 4, the first ridge part 3, the second ridge part 13 and a plurality of guiding pins 19, and wherein the second main part 17 comprises a plurality of corresponding guiding apertures 20, arranged to receive said guiding pins when the main parts 15, 17 are mounted to each other.

According to an example, at least some of the guiding pins 19 are arranged to protrude corresponding foil apertures 21.

According to an example, there is a ridge distance $d_r$ between an edge 22 of the second ridge part 13 that faces a foil slot end 23, and the foil slot end 23.

According to an example, at least one of the first ridge part 3, 3' and the second ridge part 13, 13' has at least one either stepped or continuous change of at least one of width $w_1$, $w_2$; $w_3$, $w_4$, $w_5$ and height h; $h_1$, $h_2$, $h_3$.

The invention claimed is:

1. A waveguide transition comprising a ridge waveguide section that in turn comprises a first ridge part running along a first wall in the ridge waveguide section, where there is a first distance between the first wall and an opposing second wall, wherein the waveguide transition comprises a partial H-plane waveguide section that in turn comprises at least one electrically conducting foil arranged inside the partial H-plane waveguide section and comprising a longitudinally running foil slot ending a certain edge distance before a foil edge that faces the ridge waveguide section, where the ridge waveguide section and the partial H-plane waveguide section overlap at a transition section that has a first end at a transition between the second wall and a third wall, the third wall being parallel to the second wall, where there is a second distance between the first wall and the third wall that exceeds the first distance, and where the transition section has a second end where the first ridge part ends by a transversely running second ridge part that crosses the foil slot and connects to the third wall, perpendicular to the first wall.

2. The waveguide transition according to claim 1, wherein the waveguide transition comprises a first main part which in turn comprises a first waveguide section part and a second main part which in turn comprises a second waveguide section part, the first and second main parts being arranged to be mounted to each other such that the first waveguide section part and the second waveguide section part form the ridge waveguide section and the partial H-plane waveguide section with the at least one electrically conducting foil positioned between the main parts.

3. The waveguide transition according to claim 2, wherein the first main part comprises the first wall, the first ridge part, the second ridge part and a plurality of guiding pins, and wherein the second main part comprises a plurality of corresponding guiding apertures, arranged to receive said plurality of guiding pins when the main parts are mounted to each other.

4. The waveguide transition according to claim 3, wherein at least two of the guiding pins of the plurality of guiding pins are arranged to protrude through foil apertures.

5. The waveguide transition according to claim 1, wherein there is a ridge distance between an edge of the second ridge part that faces a foil slot end, and the foil slot end.

6. The waveguide transition according to claim 1, wherein at least one of the first ridge part and the second ridge part has at least one either stepped or continuous change of at least one of width and height.

* * * * *